US011011335B2

(12) United States Patent
Xia et al.

(10) Patent No.: US 11,011,335 B2
(45) Date of Patent: May 18, 2021

(54) IN OR RELATING TO CIRCUIT INTERRUPTION DEVICES

(71) Applicant: General Electric Technology GmbH, Baden (CH)

(72) Inventors: Yang Xia, Shanghai (CN); Yongyue Ma, Shanghai (CN); Brian Kirby, Shanghai (CN); Gajendiran Balakrishnan, Stafford (GB); Hengxu Ha, Stafford (GB); Sankara Subramanian Srigopalakrishnamurthi, Stafford (GB)

(73) Assignee: General Electric Technology GmbH, Baden (CH)

( * ) Notice: Subject to any disclaimer, the term of this patent is extended or adjusted under 35 U.S.C. 154(b) by 0 days.

(21) Appl. No.: 15/536,796

(22) PCT Filed: Dec. 10, 2015

(86) PCT No.: PCT/EP2015/079313
§ 371 (c)(1),
(2) Date: Jun. 16, 2017

(87) PCT Pub. No.: WO2016/096618
PCT Pub. Date: Jun. 23, 2016

(65) Prior Publication Data

US 2017/0345598 A1 Nov. 30, 2017

(30) Foreign Application Priority Data

Dec. 16, 2014 (EP) ..... 14275257

(51) Int. Cl.
*H01H 71/12* (2006.01)
*H01H 71/04* (2006.01)
*H01H 71/24* (2006.01)

(52) U.S. Cl.
CPC ..... *H01H 71/123* (2013.01); *H01H 71/04* (2013.01); *H01H 71/2481* (2013.01); *H01H 2071/044* (2013.01)

(58) Field of Classification Search
CPC .. H01H 71/123; H01H 71/04; H01H 71/2481; H01H 2071/044
(Continued)

(56) References Cited

U.S. PATENT DOCUMENTS 4,893,102 A * 1/1990 Bauer ..... H01H 50/305 335/132
2003/0107380 A1 6/2003 Leprettre et al.
(Continued)

FOREIGN PATENT DOCUMENTS

CN 101202434 A 6/2008
CN 101527234 A 9/2009
(Continued)

OTHER PUBLICATIONS

Extended European Search Report and Opinion issued in connection with corresponding EP Application No. 14275257.5 dated May 20, 2015.
Machine Translation and First Office Action and Search Report issued in connection with corresponding CN Application No. 201510083478.X dated Aug. 11, 2017.

*Primary Examiner* — Scott Bauer
(74) *Attorney, Agent, or Firm* — Eversheds Sutherland (US) LLP

(57) ABSTRACT

A trip apparatus for a circuit interruption device that comprises a coil operatively connectable to a circuit interruption device. The coil is configured to selectively operate the circuit interruption device to interrupt when a current flowing through the circuit interruption device exceeds a threshold. The trip apparatus also includes a current measuring device configured to selectively measure a coil current flowing through the coil to determine a measured coil
(Continued)

current signal. In addition, the trip apparatus includes a monitoring device configured to determine the derivative of the measured coil current signal and to perform a correlation of the derivative of the measured coil current signal and a reference derivative of a reference coil current signal to determine a correlation output. The monitoring device is further configured to compare the correlation output with a reference correlation threshold to determine whether an operating condition of the coil is normal or abnormal.

9 Claims, 4 Drawing Sheets

(58) Field of Classification Search
USPC ..... 361/87
See application file for complete search history.

(56) References Cited

U.S. PATENT DOCUMENTS

| | | | | |
|---|---|---|---|---|
| 2005/0122117 | A1 | 6/2005 | Baurand et al. | |
| 2009/0109046 | A1* | 4/2009 | Gielniak | G01R 31/392 340/636.12 |
| 2011/0080680 | A1 | 4/2011 | Gabello et al. | |
| 2015/0162741 | A1* | 6/2015 | Valdes | H02H 7/263 361/87 |
| 2019/0222017 | A1* | 7/2019 | Miller, III | A61G 12/004 |

FOREIGN PATENT DOCUMENTS

| | | | |
|---|---|---|---|
| CN | 101849336 | A | 9/2010 |
| CN | 203932960 | U | 11/2014 |
| WO | 2008/000105 | A1 | 1/2008 |

* cited by examiner

IN OR RELATING TO CIRCUIT INTERRUPTION DEVICES

BACKGROUND TO THE INVENTION

This invention relates to a trip apparatus for a circuit interruption device, a circuit interruption device comprising such a trip apparatus, and a method of determining an operating condition of a coil in such a trip apparatus.

Fast and repeatable operation of circuit interruption devices such as circuit breakers in, e.g. high voltage power transmission networks, is essential in order to clear faults within critical clearance times. It is desirable therefore to test the correct operation of the circuit interruption devices so as to ensure the said fast and repeatable operation when required.

BRIEF DESCRIPTION OF THE INVENTION

According to a first aspect of the invention there is provided a trip apparatus for a circuit interruption device comprising: a coil operatively connectable to a circuit interruption device, the coil being configured to selectively operate the circuit interruption device to interrupt a current flowing through the circuit interruption device when the current exceeds a threshold; a current measuring device configured to selectively measure a coil current flowing through the coil to determine a measured coil current signal; and a monitoring device configured to determine the derivative of the measured coil current signal and to perform a correlation of the derivative of the measured coil current signal and a reference derivative of a reference coil current signal to determine a correlation output, the monitoring device being further configured to compare the correlation output with a reference correlation threshold to determine whether an operating condition of the coil is normal or abnormal.

The current measuring device configured to selectively measure a coil current flowing through the coil to determine a measured coil current signal permits monitoring of the coil, and hence also any associated circuit interruption device, during continued operation of the coil and circuit interruption device. This thereby avoids the need to remove the circuit interruption device from service in order to test its operation, and so likewise avoids the inconvenience and disruption caused by the associated delay and planned outage of the circuit interruption device.

Meanwhile the inclusion of a monitoring device configured to perform a correlation of the derivative of the measured coil current signal and a reference derivative of a reference coil current signal to determine a correlation output, and thereafter compare the correlation output with a reference correlation threshold to determine whether an operating condition of the coil is normal or abnormal, permits the ready and reliable indication of the operating condition of the coil, and hence the operating condition of an associated circuit interruption device, without the need for data intensive analysis using complicated clustering techniques to establish a coil current signature against which correct operation of the coil must be compared, or the need to use difficult-to-implement and computationally complex intelligent algorithms to analyse patterns in a measured coil current signal.

As a consequence the trip apparatus can be utilised throughout a whole circuit interruption event, i.e. throughout the whole circuit tripping process, and thereby is able to provide full circuit interruption device supervision.

In addition, the trip apparatus can readily be employed with a range of different circuit interruption devices from different manufacturers, each of which different circuit interruption device has differing operating characteristics.

More particularly the monitoring device is configured to perform a correlation of the derivative of the measured coil current signal and the reference derivative of the reference coil current signal using one or more of: sample based phase comparison; Fourier based phase comparison; and amplitude based phase comparison.

Each of the foregoing comparison types is able simply and reliably to establish a suitable correlation output for subsequent comparison with a reference correlation threshold to determine a normal or abnormal operating condition of the coil.

Sample based phase comparison is suitable for non-sinusoidal signals which are complex waveforms while Fourier based phase comparison is suitable for sinusoidal signals. Amplitude based comparison can be readily implemented either using a sampling method or a Fourier technique.

Optionally the monitoring device is additionally configured to filter the derivative of the measured coil current signal prior to performing a correlation of the derivative of the measured coil current signal and the reference derivative of the reference coil current signal.

Filtering the derivative of the measured coil current signal helps to improve the accuracy and repeatability with which the monitoring device is able to determine the correct operating condition of the coil, i.e. whether the coil is operating normally or abnormally.

In an embodiment of the invention the monitoring device is configured to filter the derivative of the measured coil current signal by carrying out averaging with a predetermined window size.

Averaging with a predetermined window size desirably captures only the information needed following, e.g. a circuit interruption event, while permitting the remaining information generated when the trip apparatus is in a quiescent state to be ignored.

The monitoring device may be additionally configured to perform quantisation of the derivative of the measured coil current signal prior to performing a correlation of the derivative of the measured coil current signal and the reference derivative of the reference coil current signal.

Performing quantisation of the derivative of the measured coil current signal further helps to improve the accuracy and repeatability with which the monitoring device is able to determine the correct operating condition of the coil, i.e. whether the coil is operating normally or abnormally.

Optionally the monitoring device is configured to perform quantisation of the derivative of the measured coil current signal by setting each signal value above a first quantisation threshold to 1, setting each signal value below a second quantisation threshold to −1, and setting each remaining signal value to zero.

Such configuration of the monitoring device provides a desirable degree of quantisation, while the utilisation of first and second quantisation thresholds permits a tailoring of the quantisation according to the operating characteristics of the circuit interruption device with which the trip apparatus is intended to operate.

More particularly the monitoring device is further configured to discard all signal data before the first non-zero value from the quantised derivative of the measured coil current signal.

The discarding of such signal data helps to prevent the monitoring device making an erroneous determination of the operating condition of the coil. In addition it helps to filter out any background noise.

According to a second aspect of the invention there is provided a circuit interruption device comprising a trip apparatus as described herein above.

Embodiments of the circuit interruption device share the corresponding features of the trip apparatus.

According to a third aspect of the invention there is provided a method of determining an operating condition of a coil in a trip apparatus for a circuit interruption device comprising the steps of measuring a coil current flowing through the coil and determining a measured coil current signal; determining the derivative of the measured coil current signal; performing a correlation of the derivative of the measured coil current signal and a reference derivative of a reference coil current signal to determine a correlation output; and comparing the correlation output with a reference correlation threshold to determine whether the operating condition of the coil is normal or abnormal.

Such a method is similarly able to provide monitoring of the coil during continued operation of the coil and an associated circuit interruption device, and the ready and reliable indication of the operating condition of the coil and an associated circuit interruption device without the need for data intensive analysis or the use of difficult-to-implement intelligent algorithms.

Accordingly, the method can likewise be utilised throughout a whole circuit interruption event so as to provide full circuit interruption device supervision, as well as being suitable for use with a range of different circuit interruption devices with differing operating characteristics.

BRIEF DESCRIPTION OF THE DRAWINGS

There now follows a brief description of embodiments of the invention, by way of non-limiting example, with reference being made to the following figures in which:

FIG. 2(*b*) shows a derivative of the measured coil current signal shown in FIG. 2(*a*) as determined by a monitoring device which forms a further part of the trip apparatus shown in FIG. 1;

FIG. 2(*c*) shows the outcome of filtering the derivative of the measured coil current signal shown in FIG. 2(*b*);

FIG. 2(*d*) shows the outcome of performing quantisation of the filtered derivative of the measured coil current signal shown in FIG. 2(*c*)

DETAILED DESCRIPTION

Figure 1:
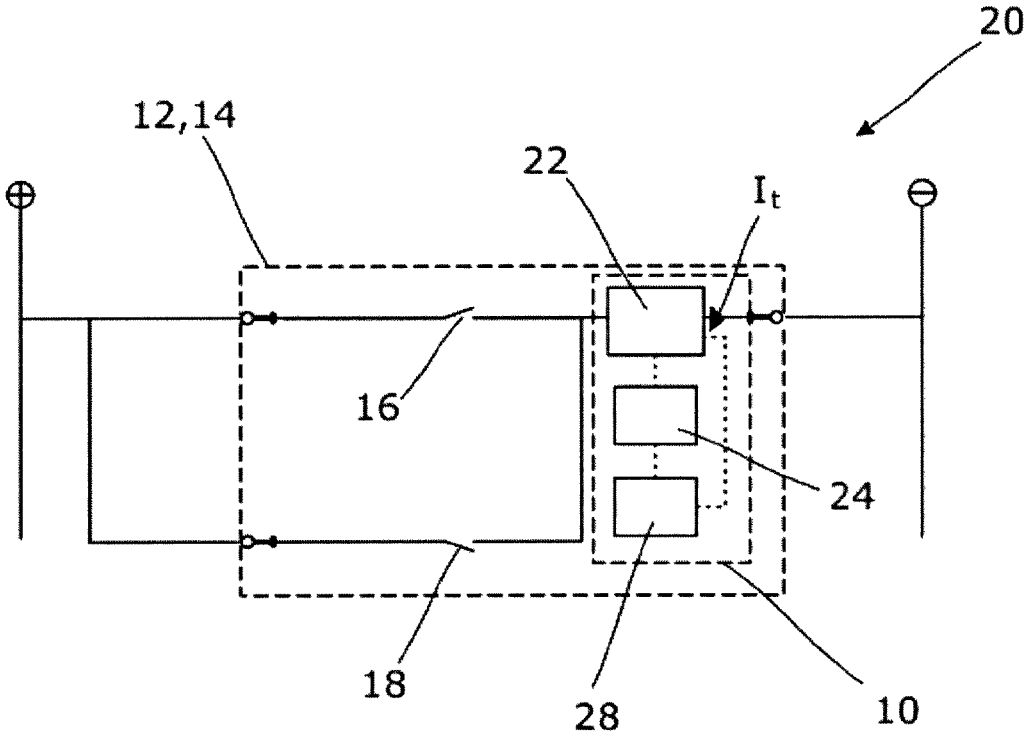
FIG. 1 shows a schematic view of a trip apparatus.
Figure 2A:
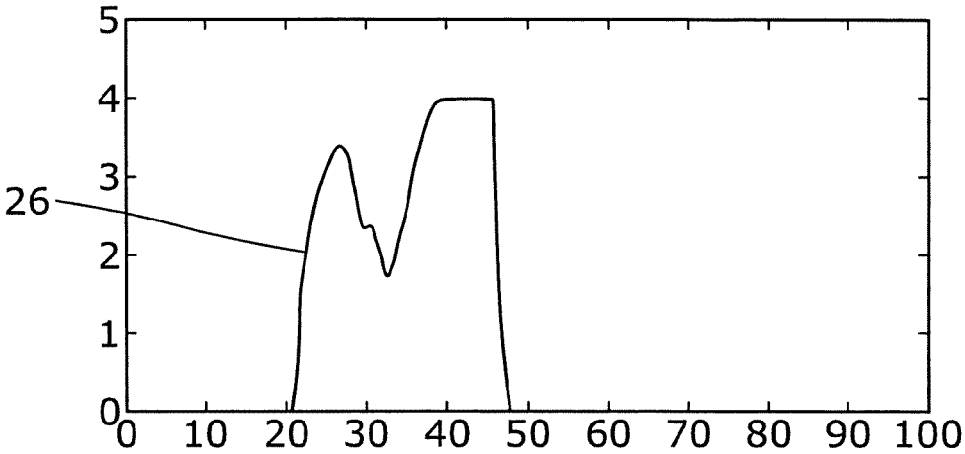
FIG. 2(*a*) shows a measured coil current signal as determined by a current measuring device which forms a part of the trip apparatus shown in FIG. 1.
Figure 2B:
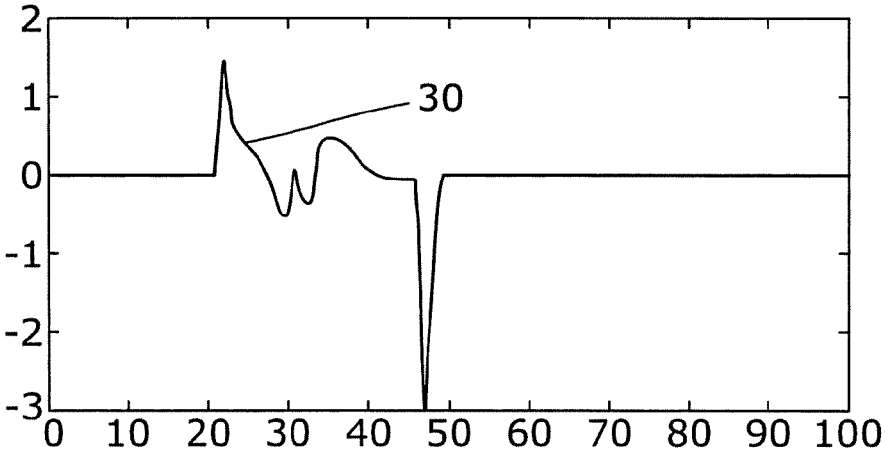
Figure 2C:
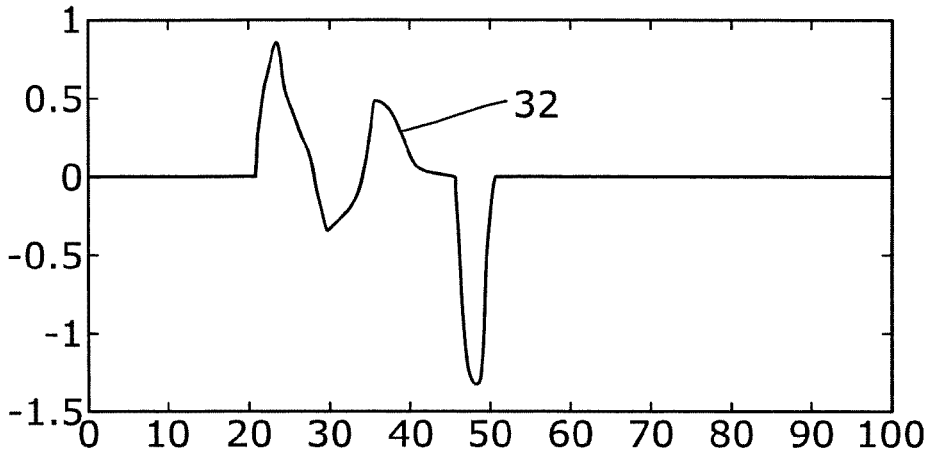
Figure 2D:
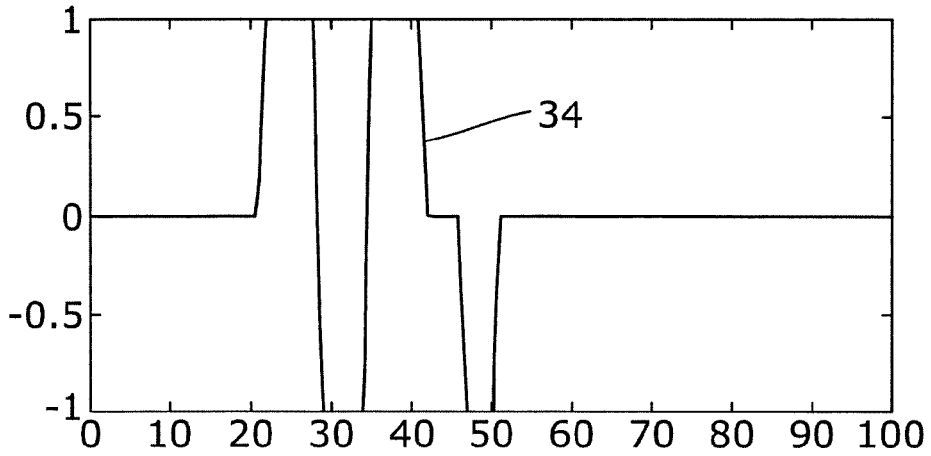

Unless otherwise defined, the technical and scientific terms used in the claims and the specification are as they are usually understood by those skilled in the art to which the present invention pertains. "First", "second" and similar words used in this specification and in the claims do not denote any order, quantity or importance, but are merely intended to distinguish between different constituents. Similarly, the terms "one", "a" and the like are not meant to be limiting, but rather denote the presence of at least one. Unless otherwise indicated, "front", "rear", "lower part" and/or "upper part" as well as similar terms are used for ease of illustration only, and are not limited to one location or a spatial orientation. In addition, "connected", "coupled" and similar words are not used to distinguish between direct or indirect connections between two elements. Of course, such elements may be connected directly or indirectly, unless otherwise stated.

A trip apparatus according to a first embodiment of the invention is designated generally by reference numeral 10.

The trip apparatus 10 forms a part of a circuit interruption device 12 which, in the embodiment shown, is a circuit breaker 14 that has first and second breaker contacts 16, 18. Other types of circuit interruption device, as well as circuit breakers with differing configurations, are also possible however. In any event, the circuit interruption device lies within a power transmission network 20.

The trip apparatus 10 includes a coil 22 which, in use, is operatively connected to the circuit interruption device 12. The coil 22 is configured to selectively operate the circuit interruption device 12 to interrupt a current (not shown) flowing through the circuit interruption device 12 when the current exceeds a threshold.

The trip apparatus 10 also includes a current measuring device 24 that is configured to selectively measure a coil current $I_t$ that flows through the coil 22. The current measuring device 24 is so configured to measure the coil current $I_t$ throughout a complete circuit interruption event, i.e. throughout the whole tripping process in embodiments in which the circuit interruption device 12 is a circuit breaker.

The current measuring device 24 is still further configured to measure the said coil current $I_t$ to determine a measured coil current signal 26, e.g. as is shown in FIG. 2(*a*).

In addition to the foregoing the trip apparatus 10 also includes a monitoring device 28.

The monitoring device 28 is configured to determine the derivative 30, e.g. as shown in FIG. 2(*b*), of the measured coil current signal 26.

For example, if the measured coil current signal 26 takes the form $$g(n)$$

then the monitoring device 28 determines $$\frac{dg(n)}{dt}$$

Figure 3:
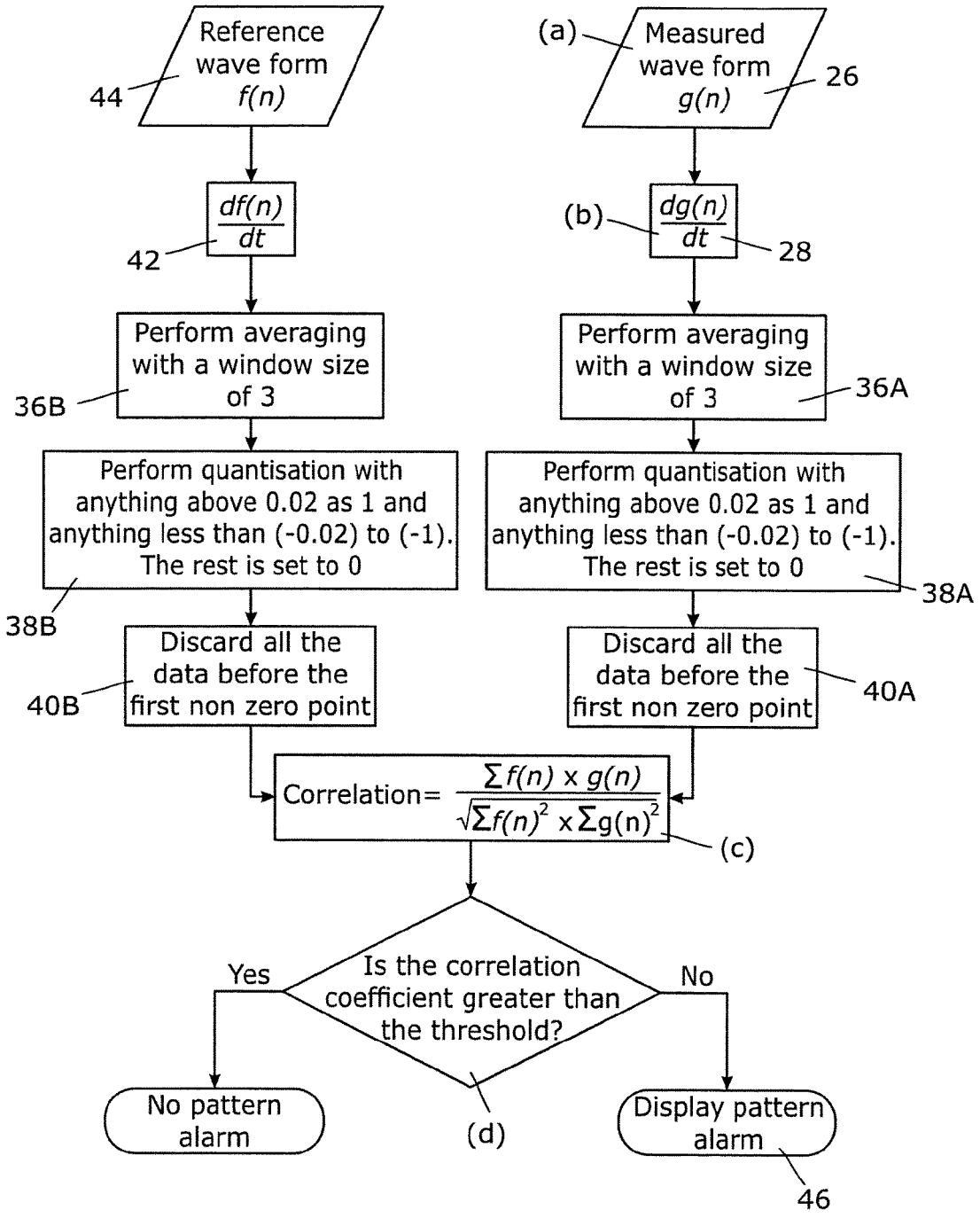
FIG. 3 illustrates various steps in a method of determining an operating condition of a coil in the trip apparatus shown in FIG. 1.

The monitoring device 28 is configured to then perform a correlation of the derivative 30 of the measured coil current signal 26 and a reference derivative 42 of a reference coil current signal 44 which, e.g. takes (as shown in FIG. 3) the form $$f(n)$$

such that its reference derivative 42 is (as shown in FIG. 3) given by $$\frac{df(n)}{dt}$$

The reference coil current signal 44 more particularly is established during commissioning of the circuit interruption device 12 such that its characteristics are selected according to the nature and type of the circuit interruption device 12 and its expected operating characteristics. Likewise the reference derivative 42 of the reference coil current signal is more particularly similarly established during commissioning of the circuit interruption device 12.

The monitoring device 28 carries out correlation of the derivative 30 of the measured coil current signal 26 and the reference derivative 42 of the reference coil circuit signal 44 in order to determine a correlation output.

In particular, in relation to the example derivative 30 and reference derivative 42 set out above, the correlation output is given by the general correlation equation of the form $$\frac{\Sigma f(n)\times g(n)}{\sqrt{\Sigma f(n)^2\times\Sigma g(n)^2}}$$

In an embodiment of the invention (not shown) the monitoring device 28 may be configured to perform a correlation of the derivative 30 of the measured coil current signal 26 and the reference derivative 42 of the reference coil signal using one or more of: (a) sample based phase comparison; (b) Fourier based phase comparison; and (c) amplitude based phase comparison.

When using sample based phase comparison, with the measured coil current signal 26 again taking the form $$g(n)$$

and the reference coil current signal 44 again taking the form $$f(n)$$

the correlation output determined by the monitoring device 28 takes the form $$\|f(n)+g(n)\|$$

and $$\|f(n)-g(n)\|$$

When using Fourier based phase comparison, the phasor of each of the derivative 30 of the measured coil current signal 26 and the reference derivative 42 of the reference coil current signal 44 is first obtained, and then the correlation output determined by the monitoring device 28 takes the form $$\mathrm{Arg}(F/G)$$

where

F is the Fourier transform of the reference coil current signal 44 in the form f(n); and G is the Fourier transform of the measured coil current signal 26 in the form g(n)

In any event, prior to performing the aforementioned correlation of the derivative 30 of the measured coil current signal 26 and the reference derivative 42 of the reference coil current signal 44, the monitoring device 28 is configured to additionally filter the derivative 30 of the measured coil current signal 26. More particularly, the monitoring device 28 is configured to filter the derivative 30 by carrying out averaging with a predetermined window size which, in the embodiment shown is 3, although in embodiments of the invention the window size may vary from 3.

Such filtering, i.e. averaging, of the derivative 30 of the measured coil current signal 26 gives rise to the filtered waveform 32 shown in FIG. 2(*c*).

The monitoring device 28 is also additionally configured to perform quantisation of the filtered derivative 30 of the measured coil current signal 26 before performing the aforementioned correlation of the derivative 30 and the reference derivative 42.

In the embodiment shown, the monitoring device 28 performs such quantisation of the filtered derivative 30 by setting each signal value above a first quantisation threshold to 1, setting each signal value below a second quantisation threshold to −1, and setting each remaining signal value to zero. More particularly, with reference to the embodiment shown, the first quantisation threshold is established at 0.02 and the second quantisation threshold is established at −0.02. Each of the first and second quantisation thresholds are more particularly established during commissioning of the circuit interruption device 12 such that their values are selected according to the nature and type of the circuit interruption device 12 and its expected operating characteristics.

By way of example, such quantisation of the filtered waveform 32 obtained from the derivative 30 of the measured coil current signal 26 gives rise to the quantised waveform 34 shown in FIG. 2(*d*).

The monitoring device 28 is still further configured to discard all signal data before a first non-zero value from the filtered, quantised derivative 30 of the measured coil signal 26, i.e. to discard all signal data before the first non-zero value in the quantised waveform 34 shown in FIG. 2(*d*).

In relation to the embodiment shown, i.e. where the monitoring device 28 is configured to filter, quantise and discard data from the derivative 30 of the measured coil current signal 26, the reference derivative 42 of the reference coil current signal 44 is filtered, quantised and has data discarded from it in an identical manner, more particularly again during commissioning of an associated circuit interruption device 12.

In this way the reference derivative 42 is similarly filtered, quantised and cleaned up prior to it correlation with the filtered, quantised and cleaned up derivative 30 of the measured coil current signal 26.

In embodiments of the invention (not shown) the reference derivative may be only one or more of filtered, quantised and/or cleaned up, e.g. during commissioning of an associated circuit interruption device, according to which one or more of these actions it is intended to have carried out by the monitoring device 28 in respect of the derivative 30 of the measured coil current signal 26 during operation of the trip apparatus 10.

Following correlation of the derivative 30 of the measured coil current signal 26 and the reference derivative 42 of the reference coil current signal 44, so as to determine a correlation output, the monitoring device 28 is configured to compare the correlation output with a reference correlation threshold.

In the first embodiment described above, i.e. when the monitoring device 28 is configured to determine a correlation output according to $$\frac{\Sigma f(n)\times g(n)}{\sqrt{\Sigma f(n)^2\times\Sigma g(n)^2}}$$

the correlation output takes the form of a single correlation output value.

In addition, in the first embodiment a first reference correlation threshold $R_{thres}$ takes the form of a specific value which is settable in 0.1 increments, although in embodiments of the invention it may instead take the form of a range. In either case the first reference correlation threshold $R_{thres}$ is more particularly again established during commissioning of an associated circuit interruption device 12, according to the nature and type of the circuit interruption device 12 and its expected operating characteristics. By way of example, one possible first reference correlation threshold $R_{thres}$ is 0.4.

If the correlation output value is equal to or greater than the first reference correlation threshold $R_{thres}$, i.e. is equal to or greater than 0.4 (or the correlation output value lies within a range defined by the first reference correlation threshold) the monitoring device 28 determines that the coil 22 is operating normally.

In contrast, if the correlation output value is less than the first reference correlation threshold $R_{thres}$, i.e. is less than 0.4, (or the correlation output value lies outside a range defined by the first reference correlation threshold) the monitoring device 28 determines that the trip coil 22 is operating abnormally.

In the second embodiment mentioned above, i.e. when the monitoring device 28 is configured to determine a correlation output using sample based phase comparison, and the correlation output takes the form $$\|f(n)+g(n)\|$$

and $$\|f(n)-g(n)\|$$

a second reference correlation threshold K is utilised in the following manner to determine whether the coil 22 is operating normally, i.e.

$$\|f(n)+g(n)\|>K*\|f(n)-g(n)\|$$

where $$K=\sqrt{\frac{1+R_{thres}}{1-R_{thres}}}$$

such that, in the example above where $R_{thres}$ is set at 0.4, the corresponding value of K is 1.53.

In the third embodiment set out above, i.e. when the monitoring device 28 is configured to determine a correlation output using Fourier based phase comparison, and the correlation output takes the form $$\mathrm{Arg}(F/G)$$

a third reference correlation threshold in the form of first and second angular limits A, B is utilised in the following manner to determine whether the coil 22 is operating normally, i.e.

$$B<\mathrm{Arg}(F/G)<A$$

where

A is $\arccos(R_{thres})$, e.g. arccos(0.4) using the example $R_{thres}$ mentioned above; and B is $-\arccos(R_{thres})$, e.g. −arccos(0.4) using the example $R_{thres}$ mentioned above.

When the monitoring device 28 is configured to determine a correlation value using amplitude based phase comparison, the aforementioned Fourier-based comparison with the third reference correlation threshold, i.e. the first and second angular limits A, B may be converted to an amplitude-based comparison, i.e.

$$B<\mathrm{Arg}(F/G)<A$$

can be implemented as $$\mathrm{imag}(F*\mathrm{conj}(G)\exp(-j*A))<0 \text{ AND (OR) } \mathrm{imag}(F*\mathrm{conj}(G)*\exp(-jB))>0$$

When the operating condition of the coil 22 is determined to be abnormal the monitoring device 28 more particularly raises an alarm, e.g. in the form of a visual and/or audible signal, since an abnormal operating condition of the coil 22 is indicative also of the circuit interruption device 12 within which the coil 22 is located being unable to operate correctly to clear a fault in the associated power transmission network 20.

In addition to the foregoing, the monitoring device 28 may also be configured to check whether the correlation output meets a predetermined correlation criteria, and to similarly raise an alarm if it does not. Such a feature provides a further safeguard in ensuring the circuit interruption device 12 is able to operate correctly when required.

It follows that in use the trip apparatus 10 is able continually to monitor the operating capability of the circuit interruption device 12 of which it forms a part, and to raise the alarm if a failure of the circuit interruption device 12 arises, i.e. as indicated by an abnormal operating condition of the coil 22 within the trip apparatus 10. The trip apparatus provides all of the aforementioned functionality without needing to know the position of the breaker contacts 16, 18 in the circuit interruption device 12, without needing a trip command to initiate the monitoring, and without having to isolate the circuit interruption device 12 from the power transmission network 20 and thereby interrupt the transmission of power through the said network 20.

Accordingly, the trip apparatus 10 is arranged to carry out a method of determining the operating condition of the coil 22 therein which includes the steps shown schematically in FIG. 3.

More particularly, the method includes the step of (a) measuring a coil current $I_t$ that is flowing through the coil 22 and thereafter determining a measured coil current signal 26, with the current measuring device 24 of the trip apparatus 10 carrying out such a step.

The method also includes: step (b) of determining the derivative 30 of the measured coil current signal 26; step (c) of performing a correlation of the derivative 30 of the measured coil current signal 26 and the reference derivative 42 of the reference coil current signal 44 to determine a correlation output; and step (d) of comparing the correlation output with a reference correlation threshold to determine whether the operating condition of the coil 22 is normal or abnormal.

Each of the foregoing steps is carried out by the monitoring device 28 of the trip apparatus 10.

As shown in FIG. 3, step (c) of performing a correlation is preceded by a respective filtering step 36A, quantisation step 38A, and data discarding step 40A.

FIG. 3 also shows that an identical filtering step 36B, quantisation step 38B, and data discarding step 40B is carried out on the reference derivative 42 of the reference coil current signal 44, prior to the aforementioned step (c) of performing correlation. More particularly these steps, along with determining the reference coil current signal 44 and the reference derivative 42 thereof, are carried out separately, e.g. during commissioning of an associated circuit interruption device 12.

In addition, as further shown in FIG. 3, following step (d) of comparing the correlation output with a reference correlation threshold to determine whether the operating condition of the coil 22 is normal or abnormal, the method includes an alarm raising step 46 which is carried out if the operating condition of the coil 22 is abnormal. Alternatively the monitoring device 28 does nothing if the operating condition of the coil 22 is normal.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A trip apparatus for a circuit interruption device comprising:

a coil operatively connectable to a circuit interruption device, wherein the coil is configured to selectively operate the circuit interruption device to interrupt a current flowing through the circuit interruption device when the current exceeds a threshold;

a current measuring device configured to selectively measure a coil current flowing through the coil to determine a measured coil current signal; and a monitoring device configured to determine the derivative of the measured coil current signal further configured to perform a correlation of the derivative of the measured coil current signal and a reference derivative of a reference coil current signal to determine a correlation output, wherein the monitoring device is further configured to compare the correlation output with a reference correlation threshold to determine whether an operating condition of the coil is normal or abnormal.

2. The trip apparatus according to claim 1, wherein the monitoring device is configured to perform a correlation of the derivative of the measured coil current signal and the reference derivative of the reference coil current signal using one or more of:

sample based phase comparison;

Fourier based phase comparison; and amplitude based phase comparison.

3. The trip apparatus according to claim 1, wherein the monitoring device is additionally configured to filter the derivative of the measured coil current signal prior to performing a correlation of the derivative of the measured coil current signal and the reference derivative of the reference coil current signal.

4. The trip apparatus according to claim 3, wherein the monitoring device is configured to filter the derivative of the measured coil current signal by carrying out averaging with a predetermined window size.

5. The trip apparatus according to claim 1, wherein the monitoring device is additionally configured to perform quantisation of the derivative of the measured coil current signal prior to performing a correlation of the derivative of the measured coil current signal and the reference derivative of the reference coil current signal.

6. The trip apparatus according to claim 5, wherein the monitoring device is configured to perform quantisation of the derivative of the measured coil current signal by setting each signal value above a first quantisation threshold to 1, setting each signal value below a second quantisation threshold to −1, and setting each remaining signal value to zero.

7. The trip apparatus according to claim 6, wherein the monitoring device is further configured to discard all signal data before the first non-zero value from the quantised derivative of the measured coil current signal.

8. The trip apparatus according to claim 1, wherein the trip apparatus is operationally connected to a circuit interruption device.

9. A method of determining an operating condition of a coil in a trip apparatus for a circuit interruption device, the method comprising:

measuring a coil current flowing through the coil and determining a measured coil current signal;

determining the derivative of the measured coil current signal;

performing a correlation of the derivative of the measured coil current signal and a reference derivative of a reference coil current signal to determine a correlation output; and comparing the correlation output with a reference correlation threshold to determine whether the operating condition of the coil is normal or abnormal.

* * * * *